US006032803A

United States Patent [19]

Nicole et al.

[11] Patent Number: 6,032,803

[45] Date of Patent: Mar. 7, 2000

[54] BULK MATERIAL SEPARATOR

[75] Inventors: Konrad Nicole, Waldburg; Ernst Reinhard, Weingarten; Norbert Wohnhas, Ravensburg, all of Germany

[73] Assignee: Waescle GmbH, Weingarten, Germany

[21] Appl. No.: 09/256,131

[22] Filed: Oct. 26, 1998

[51] Int. Cl.[7] ..... B07B 4/00

[52] U.S. Cl. ..... 209/139.1; 209/145; 209/149

[58] Field of Search ..... 209/133, 138, 209/139.1, 142, 145, 146, 147, 149

[56] References Cited

U.S. PATENT DOCUMENTS 5,238,118 8/1993 Storf ..... 209/149 X
5,788,083 8/1998 Krambrock ..... 209/139.1

FOREIGN PATENT DOCUMENTS 328074 8/1989 European Pat. Off. ..... 209/145
1286303 1/1987 U.S.S.R. ..... 209/145

*Primary Examiner*—Tuan N. Nguyen
*Attorney, Agent, or Firm*—Henry M. Feiereisen

[57] ABSTRACT

A bulk material separator having an at least substantially coaxial arrangement, includes an essentially rotationally symmetric, vertically oriented separator jacket (1) having in the upper section (11) an exit port (12) for air and light bulk material fractions and a narrowing section (15) followed by an expanding guide funnel (14), a downwardly oriented bulk material feed tube (2) extending into the top of the separator jacket (1) and ending in the region of the narrowing section (13), a displacement body (5) arranged coaxial with the bulk material feed tube (2) and arranged at least in the region of the guide funnel (14) and having an upwardly pointing conical tip (51), a container (6) having a separator air inlet port (61) and surrounding the guide funnel (14) and the displacement body (5). The bulk material feed tube (2) has a conically expanding mouth region (23), and the conical tip (51) of the displacement body (5) is immersed at least partially in this mouth region (23).

9 Claims, 4 Drawing Sheets

BULK MATERIAL SEPARATOR

BACKGROUND OF THE INVENTION

The present invention relates to a bulk material separator having an at least essentially coaxial arrangement of an essentially rotationally symmetric, vertically oriented separator jacket having an output port for air and light bulk material fractions in the upper section and a narrowed section, followed by and expanding guide funnel. The bulk material separator also includes a bulk material feed tube connected to the top of separator jacket and directed downwardly and terminating in the region of the narrowed section, a displacement body that is coaxial with the bulk material feed tube and disposed at least in the region of the guide funnel and has an upwardly pointing conical tip, and a container surrounding at least the guide funnel and the displacement body and provided with a separator air inlet port.

A separator of this type is known from DE 44 16 757 A1. This separator is designed to provide a constant air velocity across the cross-section in the annular space between the bulk material feed tube and the displacement body projecting far into the feed tube. For this purpose, the inner wall of the cylindrical bulk material feed tube and the jacket of the cylindrical displacement body are provided with a surface structure that increases the roughness. In the elongated annular space of the known separator, the bulk material particles relatively frequently impact the inner wall of the bulk material feed tube and/or the jacket of the displacement body and slow down with each impact. This can produce so-called shot grain. These are bulk material particles, which because of their low velocity are entrained in the separator air, although they are not part of the constituents of the bulk material to be separated. Contact between the bulk material particles and the walls also promotes the generation of dust and thread-like abrasion. Consumption of separator air is also relatively high, since a portion of the separator air flows upwardly into the separator jacket without prior intensive contact with the bulk material particles.

SUMMARY OF THE INVENTION

It is therefore an object of the invention to provide an improved separator of the type described above, which produces less abrasion and preferably consumes also less separator air.

The proposed separator of the invention solves this object by providing the bulk material feed tube with a conically expanding mouth region and by immersing the conical tip of the displacement body at least partially in the mouth region.

The conical tip of the displacement body provides the flow in the bulk material feed tube with a radial component. However, since the bulk material feed tube expands conically in this region, the bulk material particles make less frequently contact with the wall of the bulk material feed tube. The abrasion decreases accordingly. At the same time, the quality of the separation process improves, partially because only very little shot grain is produced. The conical expansion of the mouth region of the bulk material feed tube has the additional beneficial effect that the annular gap between the mouth of the bulk material feed tube and the separator jacket becomes narrower and moves radially outwardly. This feature accelerates the separator airflow (while the amount of separator air per unit time remains unchanged) and causes the main flow direction to intersect the main direction of the bulk material feed at an acute angle. Both processes lead to lower separator air consumption by improving the separation efficiency. The proposed invention has the further advantage that a small alignment error of the displacement body relative to the axis of the bulk material feed tube does not significantly degrade the separation quality, since the displacement body is immersed only with its conical tip and only in the mouth region of the bulk material feed tube, which is different from conventional separator is where the displacement body projects very deep in the bulk material feed tube.

In a preferred embodiment, the bulk material feed tube has the form of an acceleration tube (claim 2). The bulk material flow can be accelerated in several ways known in the art. In particular, the cross-section of an end section of the bulk material feed tube before the mouth region can be smaller than the cross-section of the bulk material inlet side. A high velocity of the bulk material flow which is to be separated, is particularly advantageous, if the separation is mainly intended to separate dust-like constituents adhering to the bulk material particles.

In a particularly advantageous arrangement for achieving excellent separation, the extension of the generatrix of the conical mouth region of the bulk material feed tube is located in the open cross-section between the guide funnel and the displacement body (claim 3). The number of the bulk material particles impacting the inner wall of the separator jacket is thereby kept exceptionally low.

The conical tip of the displacement body together with the conical mouth region of the bulk material feed tube advantageously confine a conically expanding annular space that has a constant gap width along its entire length (claim 4). This feature converts the bulk material flow very efficiently into a conically expanding flow and eliminates locally varying bulk material concentrations.

The conical tip of the displacement body should have an acute angle of 10° to 30°, preferably 20° (claim 5). Advantageously, this range is trade-off between values that are too small and therefore increase the overall length and decrease the angle at which the bulk material flow and the separator air flow intersect, and angles that are too large and therefore increase the wall impact frequency of bulk material particles and overly decrease the flow velocity of the bulk material. At both limit values, the quality of separation process deteriorates.

To increase the separator air velocity, the transition between the displacement body and its conical tip can be located approximately at the height of the smallest diameter of the guide funnel (claim 6).

The largest diameter of the conical tip of the displacement body can also be larger than the diameter of the displacement body (claim 7). The displacement body—when viewed in the direction of the bulk material flow—has then an undercut after the conical tip. The number of bulk material particles impacting the wall of the displacement body after passing through the separator region, can thereby be kept especially small. The undercut—when viewed in the direction of the separator airflow—also forms an obstacle causing a turbulent flow that can improve both the flow characteristics of the bulk material particles and the separation effect.

The displacement body can be movable in the vertical direction (claim 8). By moving the displacement body, the gap width of the conically expanding annular space between the conical mouth region of the bulk material feed tube and the conical tip of the displacement body can be conveniently adjusted, e.g. to optimize the separation process. This embodiment is therefore particularly suited for separators separating bulk material having different properties.

At least in certain regions, the conical tip of the displacement body can have a star-shaped cross-section (claim 9). It has been observed that this embodiment facilitates the separation of thread-like fractions (so-called angel hair) from the bulk material flow.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
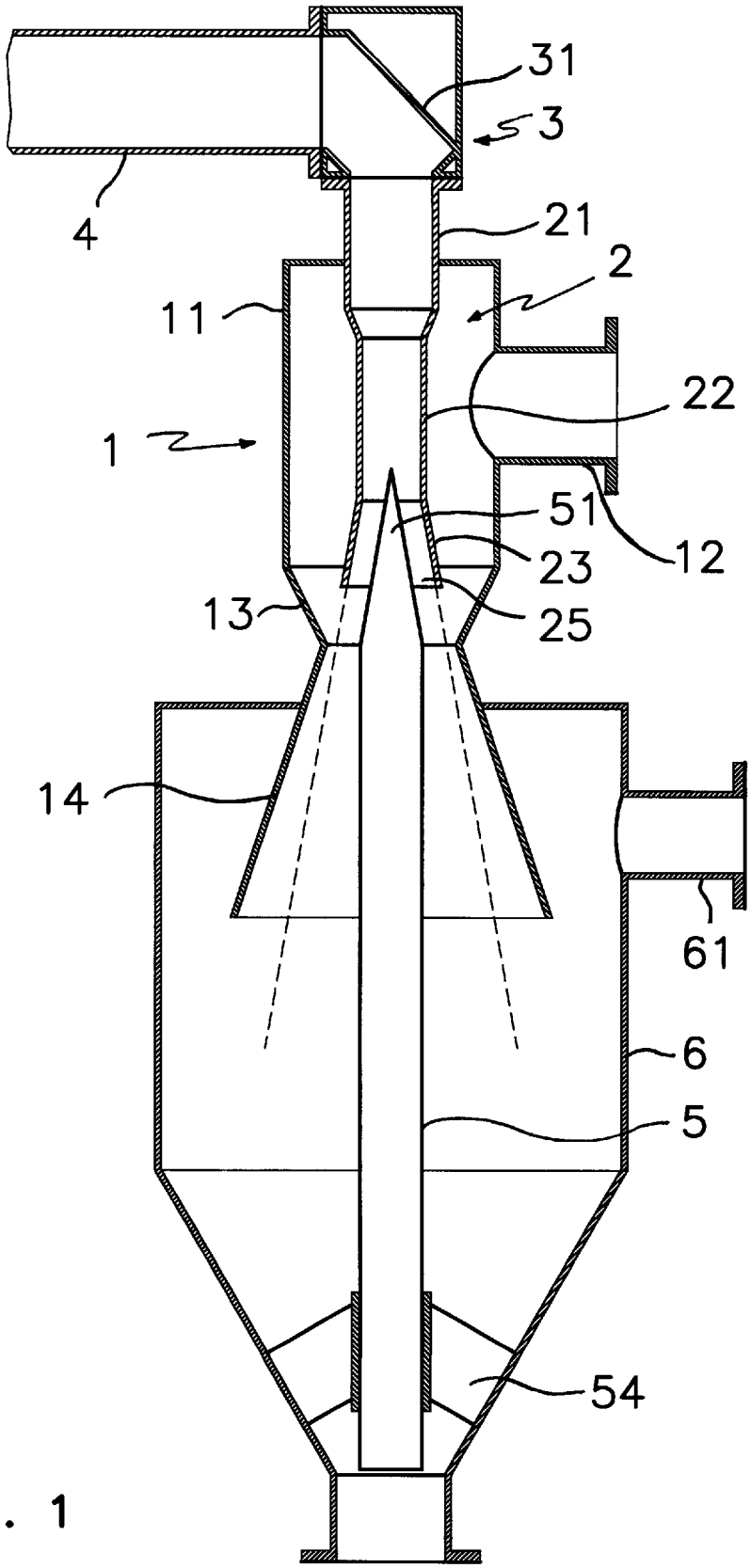
FIG. 1 shows a longitudinal section of a first embodiment.

The bulk material separator illustrated in FIG. 1 includes a separator jacket 1 with an upper cylindrical region 11 provided with a lateral exit port 12 for air and light bulk material fractions. Following the cylindrical region 11 is a conically narrowing section 13, which is followed by an expanding guide funnel 14.

A bulk material feed tube 2 connects centrally from above with the separator jacket 1 and is connected to a bulk material conveyor tube 4 via a deflection flange 3 with a deflection plate 31 for smoothing the deflection of the bulk material flow. The bulk material feed tube 2 is formed as an acceleration tube and has a first section 21 with a cross-section that is smaller than the cross-section of the conveyor tube 4, and a second section 22 with a cross-section that is still smaller than the cross-section of the first section 21. The second section 22 transitions into a conically expanding mouth region 23 of the bulk material feed tube 2. The cross-section of the mouth and consequently also the largest diameter of the mouth region 23 is located approximately at half the height of the narrowing section 13 of the separator jacket 1.

A displacement body 5 with a conical tip 51 having an acute angle of approximately 20° projects into the mouth region 23. The displacement body 5 is arranged in a container 6 and supported by a vertically movable support 54, as illustrated schematically. The guide funnel 14 of the separator jacket 2 merges in the container 6 which is provided with a separator air input port 61. The gap width of the conically expanding annular space 25 between the conical tip 51 of the displacement body 5 and the conical mouth region 23 of the bulk material feed tube 2 can be adjusted by raising and lowering the displacement body 5.

Figure 2:
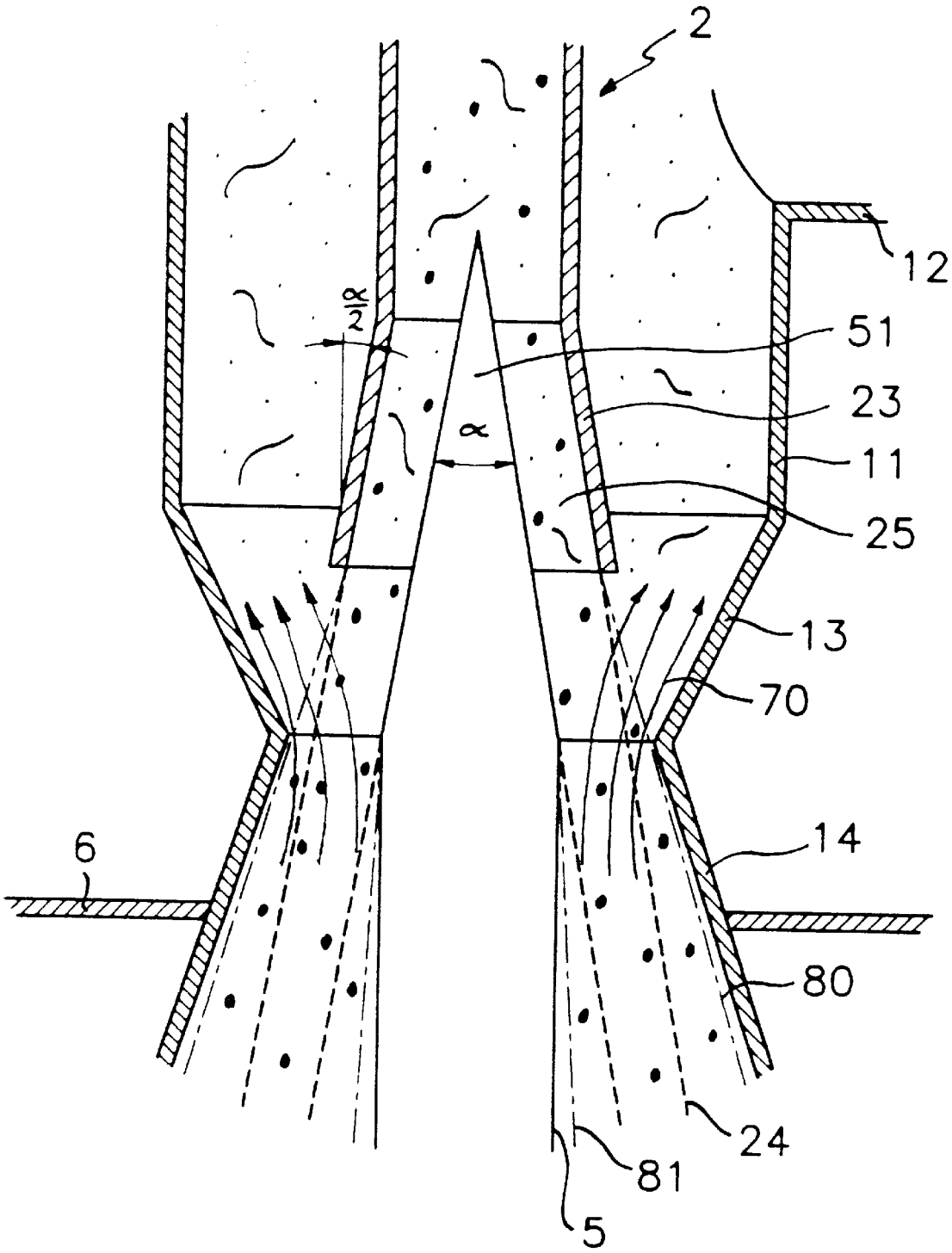
FIG. 2 shows the separator space of the separator of FIG. 1, on an enlarged scale.

FIG. 2 schematically illustrates the flow conditions in the separator space of the separator according to FIG. 1. The conical tip 51 of the displacement body 5 has an acute angle a. The generatrix of the conical mouth region 23 of the bulk material feed tube 2 encloses an angle of a/2 with the vertical. The extension 24 of the generatrix (which is shown as a dashed line) of the inner jacket surface of the mouth region 23 does not make contact with the separator jacket 1 at any point, neither in the region of the narrowing section 13 nor in the region of the expanding guide funnel 14. In other words, the extension 24 is located in the open cross-section between the guide funnel 14 and is the displacement body 5. The bulk material flow supplied via the bulk material feed tube 2 expands in the conically expanding annular space 25 that has a constant gap width s. The bulk material flow expands further when exiting the cross section at the mouth, in part due to the separator air flowing in a direction indicated by the arrows 70. In order to retain at least the largest portion of the indicated bulk material particles in the volume that is bounded on the outside by the dashed line 80 and on the inside by the dashed line 81, the smallest diameter of the separator jacket 1 at the height where the narrowing section 13 transitions into the guide funnel 14, is chosen to be such that the extension 24 of the generatrix of the conical mouth region 23 of the bulk material feed tube 2 intersects the narrowest cross section area approximately near the outer third of the cross section area.

With this geometry, the main direction of the separator air which is indicated by the arrows 70, intersects the main direction of the bulk material flow which follows approximately the extension 24 of the generatrix of the mouth region 4, above the narrowest cross section at an acute angle. It has been observed that not only the dust and thread-like fractions entrained in the bulk material flow, but more importantly, also the dust that directly adheres to the bulk material particles (e.g. to the granules), can be separated extremely efficiently.

Figure 3:
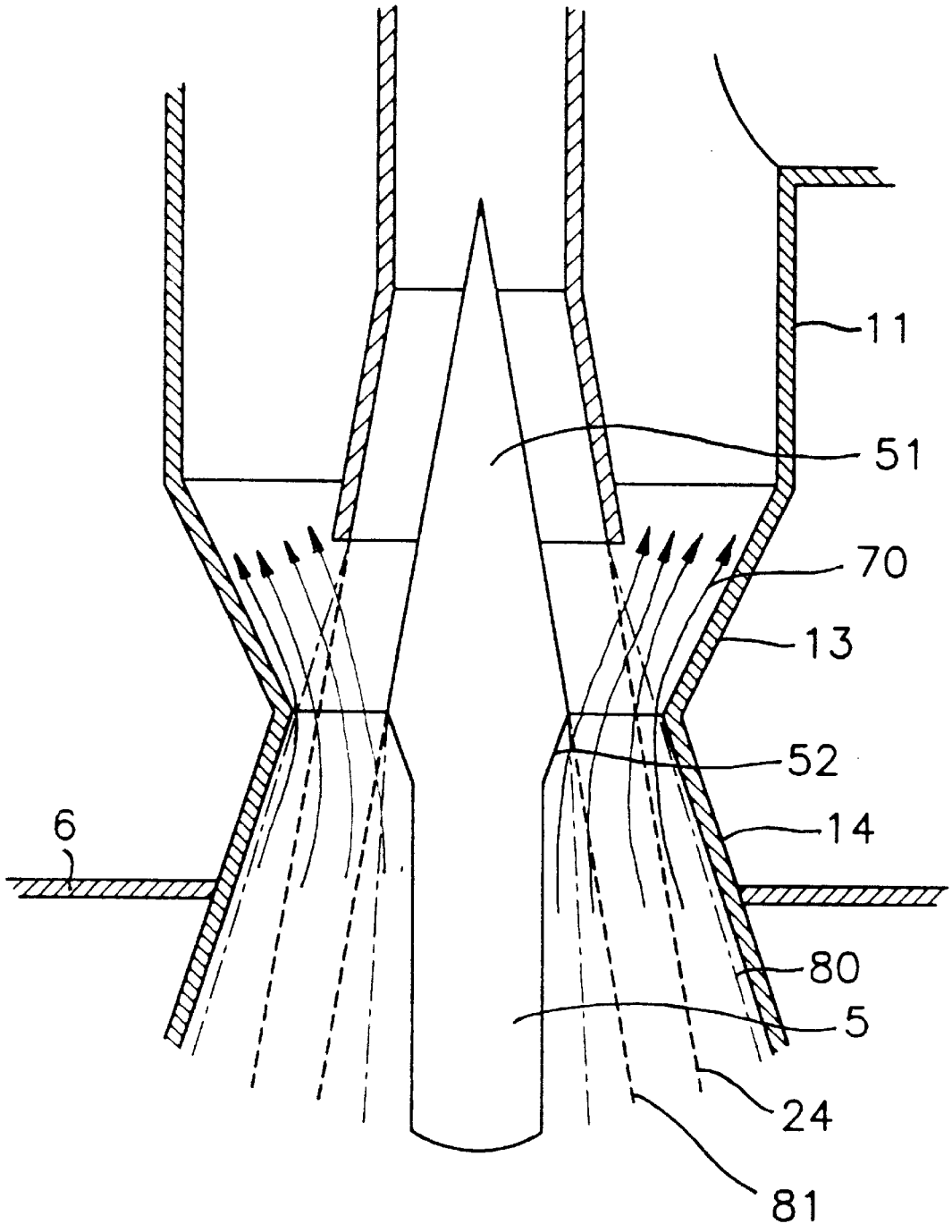
FIG. 3 shows the separator space of a second embodiment of the separator.

This effect is enhanced even more in the embodiment illustrated in FIG. 3, where the largest diameter, i.e. the base of the conical tip 51, is larger than the diameter of the displacement body 5. When viewed in the direction of the bulk material flow, an undercut 52 is arranged following the conical tip 51, making the probability for contact between bulk material particles and the jacket surface of the displacement body 5 extremely small. Conversely, the increase in diameter where the displacement body 5 transitions into its conical tip 51 causes an additional deflection of the separator air. This additional deflection can cause small local turbulent flow regions which can improve the separator action even more.

Figure 4:
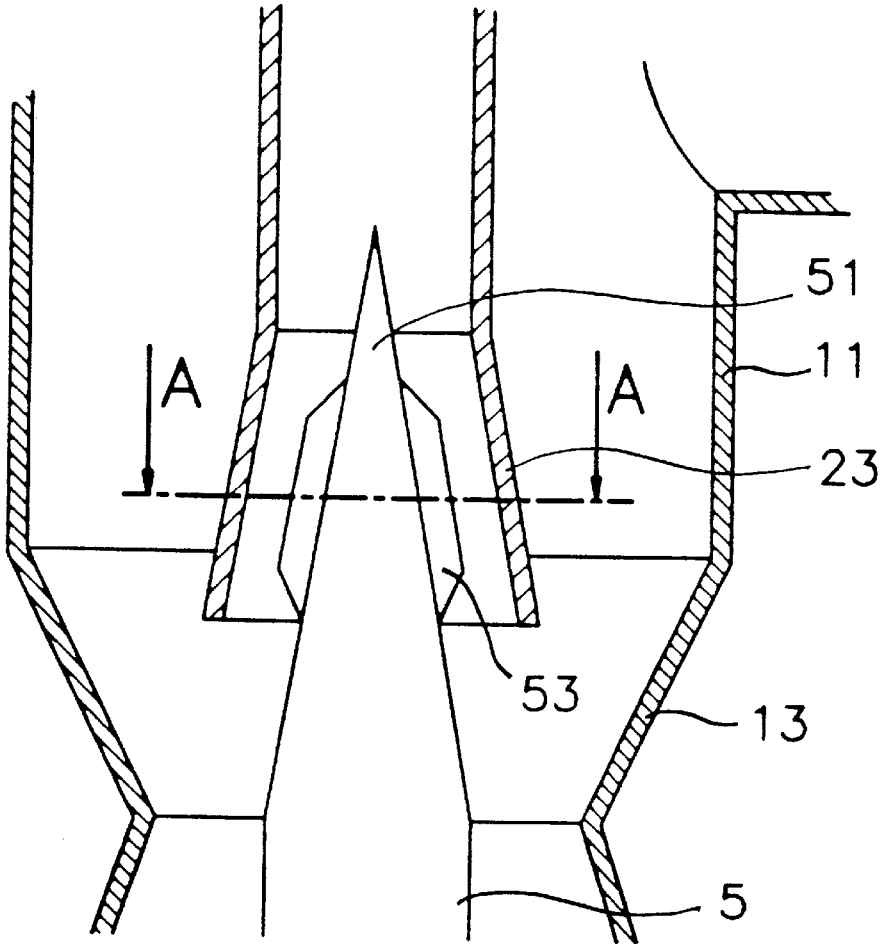
FIG. 4 shows the separator space of a third embodiment of the separator.
Figure 5:
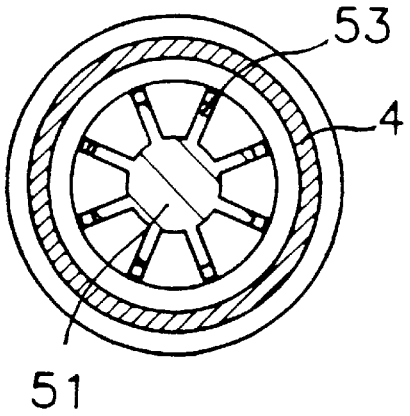
FIG. 5 shows a partial cross-section taken along the line A—A of FIG. 4.

In the embodiment according to FIGS. 4 and 5 the conical tip 51 of the displacement body 5 is provided with fins 53 arranged in axial planes. The narrow end faces of the fins 53 facing to bulk material flow are beveled. The fins 53 do not necessarily have to be located at the same height as the mouth cross-section of the mouth region 23 of the bulk material feed tube 2. The fins 53 pre-orient any thread-like constituents that are contained in the bulk material to be separated. It has been observed that the thread-like constituents can thereby be more easily separated.

What is claimed is:

1. A bulk material separator having an at least substantially coaxial arrangement comprising:

an essentially rotationally symmetric, vertically oriented separator jacket (1) having in the upper section (11) an exit port (12) for air and light bulk material fractions and a narrowing section (15) followed by an expanding guide funnel (14), a downwardly oriented bulk material feed tube (2) extending into the top of the separator jacket (1) and ending in the region of the narrowing section (13), a displacement body (5) arranged coaxial with the bulk material feed tube (2) and arranged at least in the region of the guide funnel (14) and having an upwardly pointing conical tip (51), and a container (6) having a separator air inlet port (61) and surrounding the guide funnel (14) and the displacement body (5), wherein the bulk material feed tube (2) has a conically expanding mouth region (23), and the conical tip (51) of the displacement body (5) is immersed at least partially in this mouth region (23).

2. The separator according to claim 1 wherein the bulk material feed tube (2) is formed as an acceleration tube (21, 22).

3. The separator according to claim 1 wherein the extension (24) of the generatrix of the conical mouth region (23) of the bulk material feed tube (2) is located in the open cross-section between the guide funnel (13) and the displacement body (5).

4. The separator according to claim 1 wherein the conical tip (51) of the displacement body (5) together with the conical mouth region (23) of the bulk material feed tube (2) bounds a conically expanding annular space (25) that has a constant gap width (s) along its entire length.

5. The separator according to claim 1 wherein the conical tip (51) of the displacement body (5) has an acute angle of between 10° and 30°, preferably 20°.

6. The separator according to claim 1 wherein the transition between the displacement body (5) and its conical tip (51) is located approximately at the height of the smallest cross-section of the guide funnel (14).

7. The separator according to claim 1 wherein the largest diameter of the conical tip (51) of the displacement body (5) is larger than the diameter of the displacement body (5).

8. The separator according to claim 1 wherein the displacement body (5) is adapted for vertical displacement.

9. The separator according to claim 1 wherein the conical tip (51) of the displacement body (5) has at least in certain regions a star-shaped cross-section.

* * * * *

UNITED STATES PATENT AND TRADEMARK OFFICE

CERTIFICATE OF CORRECTION

PATENT NO. : 6,032,803

DATED : March 7, 2000

INVENTOR(S) : Konrad Nicole, Ernst Reinhard & Norbert Wohnhas

It is certified that error appears in the above-identified patent and that said Letters Patent is hereby corrected as shown below:

[73] Assignee: change "Waescle" to --Waeschle--

Column 3, line 51, change "2" to --1--;
Claim 1, line 56, change "15" to --13--;
Claim 3, line 11, change "13" to --14--.

Signed and Sealed this

Third Day of April, 2001

*Attest:*

Nicholas P. Godici

NICHOLAS P. GODICI

*Attesting Officer*

*Acting Director of the United States Patent and Trademark Office*